United States Patent [19]

Ziemba

[11] 3,955,507

[45] May 11, 1976

[54] PROXIMITY FUSE

[75] Inventor: Richard T. Ziemba, Burlington, Vt.

[73] Assignee: General Electric Company, Burlington, Vt.

[22] Filed: Dec. 23, 1963

[21] Appl. No.: 332,970

[52] U.S. Cl. ..... 102/70.2 P; 102/60

[51] Int. Cl.[2] ..... F42C 13/02

[58] Field of Search ..... 102/70.2, 70.2 P, 57, 102/60; 244/3.16, 14 E; 307/88.5, 21.5, 23.5; 317/235

[56] References Cited

UNITED STATES PATENTS

| | | | |
|---|---|---|---|
| 2,557,949 | 6/1951 | Deloraine | 102/70.2 |
| 2,927,213 | 3/1960 | Marion et al. | 102/70.2 |
| 3,055,303 | 9/1962 | Giraudo | 102/70.2 |
| 3,116,039 | 12/1963 | Goldberg | 244/14 E |
| 3,225,695 | 12/1965 | Kapp et al. | 102/70.2 |

OTHER PUBLICATIONS

Solid State Products, Inc., Aug. 21, 1961.

*Primary Examiner*—Charles Jordan

EXEMPLARY CLAIM

1. A method of detonating a high explosive (HE) projectile before it contacts a target comprising:

1. firing a first high explosive incendiary (HEI) projectile at a target, said first projectile containing a first explosive which produces an electromagnetic radiation of predetermined frequency and magnitude during combustion;

2. firing a second high explosive (HE) projectile at the target after said first high explosive incendiary (HEI) projectile is fired;

3. impacting said first high explosive incendiary (HEI) projectile on said target, said first projectile containing fusing means for detonating said first explosive on impact; and 4. detonating said second high explosive (HE) projectile by use of fusing means therein actuated solely by said electromagnetic radiation resulting from combustion of said first explosive on impact of said first high explosive incendiary (HEI) projectile on said target.

1 Claim, 3 Drawing Figures

INVENTOR
RICHARD T. ZIEMBA
BY R H Quist
ATTORNEY

PROXIMITY FUSE

This invention relates generally to fuses for detonating an explosive charge and more particularly to a proximity fuse and the method of using it.

Proximity fuses have been used for projectiles in the past, but their method of operation has required complicated circuitry which cannot be contained within ammunition of smaller sizes such as the 20mm high explosive (HE) round. The 20mm HE and HEI (high explosive incendiary) rounds are fired by air borne rapid-fire cannons. An HE round would be more effective against personnel and possibily other targets if it could be exploded before reaching its target.

Operation of previous proximity fuses has depended upon active systems wherein the fuses transmit a signal of some type and are detonated when a reflection of this signal having particular characteristics is received. This active type proximity fuse requires a substantial source of power.

It is, therefore, an object of this invention to provide a proximity fuse small enough to be used in smaller projectiles such as 20mm HE ammunition.

It is also an object of this invention to provide a proximity fuse which will be passive in operation.

In accordance with a preferred embodiment of the invention, an HE round is equipped with a silicon controlled rectifier (SCR) which is optically gated, i.e., it conducts current when exposed to electromagnetic radiation of a particular frequency and magnitude. This SCR is used as a normally open switch between a battery and the squib bridge wire. The electromagnetic radiation required to gate the SCR is provided by firing an ordinary HEI round at the target and then firing the proximity fused round of this invention. When the HEI round contacts the target, it detonates and the electromagnetic radiation produced impinges on the following proximity fused round causing it to explode a distance from the target which will be approximately the distance between the two rounds.

The invention will be better understood from the following description taken in connection with the accompanying drawing, in which.

Figure 1:
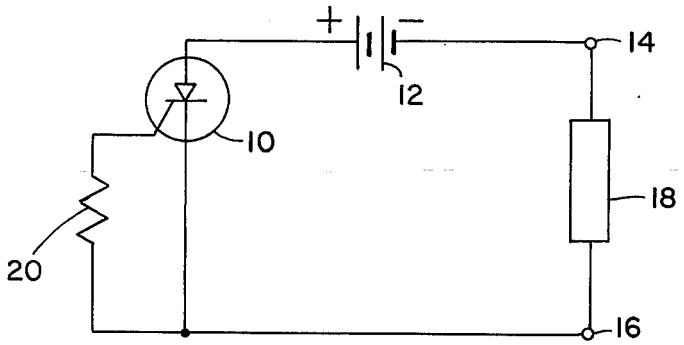
FIG. 1 is a schematic diagram of the circuit utilized in this invention.

The circuit for the proximity fuse of this invention is shown in FIG. 1 as including silicon control rectifier (SCR) 10. SCR 10 is an optically gated PNPN solid state device having a high impedance when it has not been exposed to electromagnetic radiation. Connected to SCR 10 is battery 12, the source of electrical energy for the circuit. Terminals 14 and 16 are provided to connect the circuit to a load 18. Normally, load 18 would be the bridge wire of a squib. Connected to the gate electrode of SCR 10 is resistor 20. The other lead of resistor 20 is connected to the cathode of SCR 10 and through terminal 16 to load 18. The function of resistor 20 will be described later.

Figure 2:
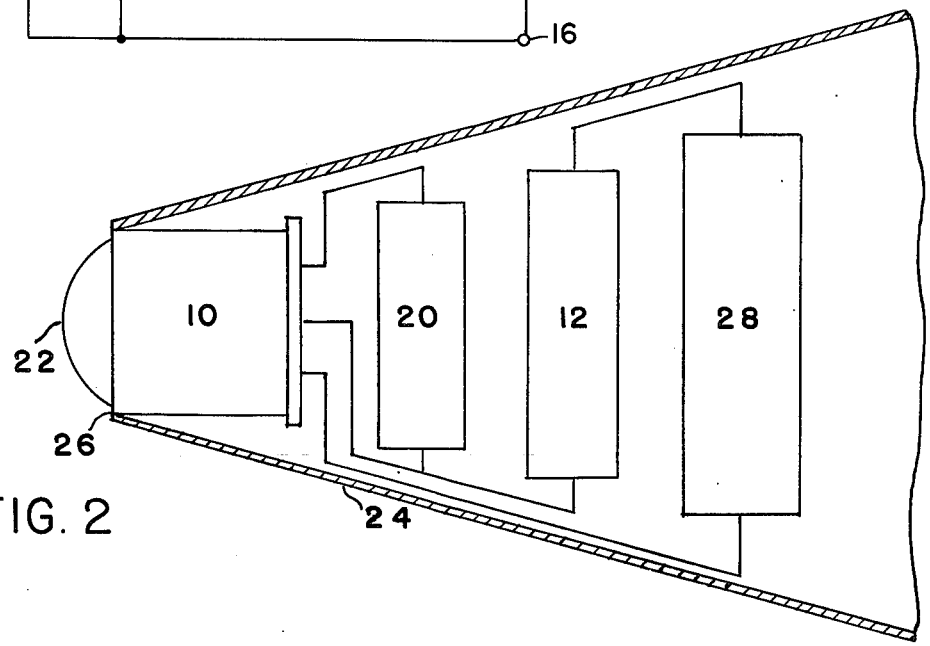
FIG. 2 is a schematic diagram in cross-section of the nose of a round of ammunition containing the proximity fuse of this invention.
Figure 3:
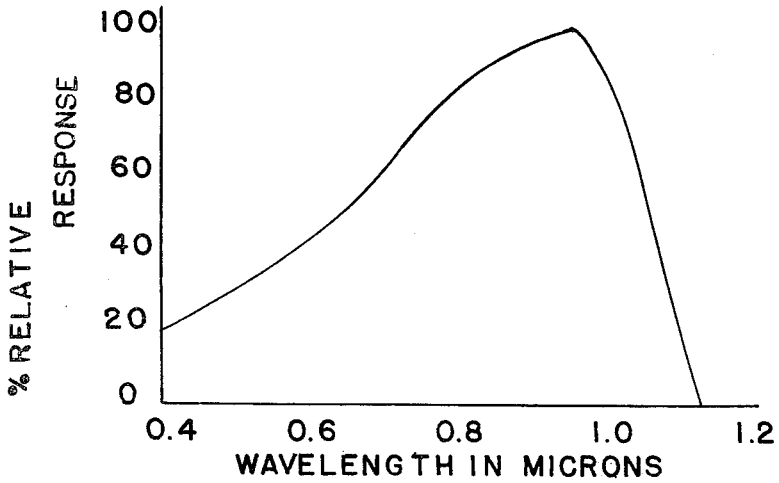
FIG 3 is a graph showing the relative response of a silicon controlled rectifier to light of various wavelengths.

The circuit elements shown in FIG. 1 are contained within the nose of the round of ammunition in the space ordinarily provided for the fuse. As shown in FIG. 2, SCR 10 is positioned so that its lens 22 is directed towards the target. The wall 24 of the projectile terminates to leave opening 26 for lens 22. Battery 12 and resistor 20 are also contained in this space. Detonator 28 is electrically connected in the circuit in the position of load 18 of FIG. 1. Mounting means, not shown, for securing the various elements in position would also be provided.

In operation, an ordinary round of ammunition containing a high explosive incendiary charge is fired at a target. A round of the proximity fused ammunition of this invention is then also fired at the target. When the first HEI round of ammunition strikes the target, it produces an intense burst of electromagnetic radiation. The round of ammunition containing the proximity fuse, having been fired at a later time, will still be some distance away from the target. The electromagnetic radiation produced by the first round, however, impinges on SCR 10 and is sufficient to cause an avalanche of current through SCR 10 to detonator 28.

It is evident that this arrangement will not function as desired if ordinary daylight or ambient illumination is sufficient to reduce the impedance of SCR 10 sufficiently to cause avalanche current flow. The electromagnetic radiation which impinges on SCR 10 generates current carriers in a quantity which is proportional to the intensity of the radiation. Resistor 20 is connected to the gate electrode of SCR 10 to provide a path through which light generated current carriers will drain. Varying the resistance of resistor 20 consequently changes the sensitivity of SCR 10 to electromagnetic radiation. When the resistance of resistor 20 is lowered, a greater quantity of electromagnetic radiation is necessary to produce avalanche current flow through SCR 10.

In an experiment designed to demonstrate the invention, resistor 20 had a resistance of 2000 ohms, battery 12 supplied 6 volts, and a miniature lamp was used as load 18. A charge of explosive of the type used in 20mm HEI rounds was ignited about 35 feet from optically gated silicon controlled rectifier 10. The lamp lit and remained lighted.

The SCR used was Type 3P30 manufactured by Solid State Products, Inc., Salem, Mass. This device has an impedance of about 10 megohms when not radiated and of about 10 ohms when suitable radiation has been provided.

The explosive charge was the standard RDX (cyclotrimethylenetrinitramine) to which is added about thirty per cent by volume aluminum powder as in the HEI rounds.

This charge emits electromagnetic radiation throughout the spectrum including the ultraviolet and infrared regions. SCR 10, on the other hand, has the spectral response indicated in FIG. 2. Consequently, the radiation beyond that indicated in FIG. 2 is not required for operation.

It appears that the proximity fuse of this invention will be actuated if the rounds are fired directly at the sun. Since these projectiles will probably be most effective against personnel in strafing operations, this does not appear to be a serious defect. It does indicate the desirability of including some type of arming device.

One method for providing a safe arming arrangement is to use a thermal battery as the source of electrical energy. This type of battery maintains the electrolyte in a solid removed from the battery plates. When sufficient heat is applied (in this case by the friction of the atmosphere on the projectile), the solid melts putting the battery in a charged condition.

It is obvious that other changes and modifications can be made without departing from the spirit of the invention and the scope of the appended claims.

What is claimed as new and desired to be secured by Letters Patent of the United States is:

1. A method of detonating a high explosive (HE) projectile before it contacts a target comprising:

1. firing a first high explosive incendiary (HEI) projectile at a target, said first projectile containing a first explosive which produces an electromagnetic radiation of predetermined frequency and magnitude during combustion;

2. firing a second high explosive (HE) projectile at the target after said first high explosive indendiary (HEI) projectile is fired;
3. impacting said first high explosive incendiary (HEI) projectile on said target, said first projectile containing fusing means for detonating said first explosive on impact; and
4. detonating said second high explosive (HE) projectile by use of fusing means therein actuated solely by said electromagnetic radiation resulting from combustion of said first explosive on impact of said first high explosive incendiary (HEI) projectile on said target.

* * * * *